US009597717B1

(12) United States Patent
Snow

(10) Patent No.: US 9,597,717 B1
(45) Date of Patent: Mar. 21, 2017

(54) PIPE CLEANING APPARATUS

(71) Applicant: Daniel Wayne Snow, Andrews, TX (US)

(72) Inventor: Daniel Wayne Snow, Andrews, TX (US)

( * ) Notice: Subject to any disclaimer, the term of this patent is extended or adjusted under 35 U.S.C. 154(b) by 0 days.

(21) Appl. No.: 15/167,800

(22) Filed: May 27, 2016

Related U.S. Application Data

(62) Division of application No. 13/385,634, filed on Feb. 27, 2012.

(51) Int. Cl.

| | |
|---|---|
| ***B08B 9/032*** | (2006.01) |
| ***B08B 9/043*** | (2006.01) |
| ***B08B 9/045*** | (2006.01) |
| ***B08B 13/00*** | (2006.01) |

(52) U.S. Cl.
CPC ..... *B08B 9/0436* (2013.01); *B08B 9/045* (2013.01); *B08B 13/00* (2013.01)

(58) Field of Classification Search
CPC ..... B08B 9/032; B08B 9/045; B08B 9/0436; B08B 13/00; E21B 12/06
See application file for complete search history.

(56) References Cited

U.S. PATENT DOCUMENTS 2,267,435 A * 12/1941 Thomas ..... H01J 9/20 15/104.05
2,838,778 A * 6/1958 Von Arx ..... F23J 3/02 118/105
2,967,316 A 1/1961 Kandle
3,164,491 A 1/1965 Brockett et al.
3,799,443 A 3/1974 Foster et al.
3,817,262 A 6/1974 Caradeur et al.
3,835,587 A * 9/1974 Hall, Jr. ..... B24C 3/325 451/38
3,938,535 A 2/1976 Cradeur et al.
4,095,305 A 6/1978 Goodwin
4,156,949 A * 6/1979 Ziegelmeyer ..... B08B 9/023 15/88
4,166,301 A 9/1979 Smith
4,271,556 A * 6/1981 Farrell, Jr. ..... E03F 9/00 15/104.12
4,306,914 A * 12/1981 Long ..... B08B 9/027 134/1
4,600,444 A * 7/1986 Miner ..... B08B 9/021 134/10

(Continued)

*Primary Examiner* — Michael Barr
*Assistant Examiner* — Benjamin L Osterhout
(74) *Attorney, Agent, or Firm* — Buskop Law Group, PC; Wendy Buskop

(57) ABSTRACT

A pipe cleaning apparatus for cleaning the insides of pipes, tubes, and conduits having a pipe support assembly. The pipe support assembly having a plurality of cradles positioned side-by-side to support oilfield pipe. The pair of cradles has C-shaped clamping members, engaging the opposite sides of a pipe and locking the pipe within the pair of cradles. A pipe feeder delivers the oilfield pipe to a plurality of cradles and a pipe receiver receives the oilfield pipe from the plurality of cradles. The pipe cleaning apparatus has a plurality of lances positioned side by side to penetrate the oilfield pipe. The plurality of lances are affixed to a mill, an air-driven tube cleaner, and a water jet nozzle. A pair of pipe conveyors moves the oilfield pipe from one pair of cradles to another pair of cradles.

3 Claims, 4 Drawing Sheets

(56) References Cited

U.S. PATENT DOCUMENTS

| | | | | |
|---|---|---|---|---|
| 4,704,986 | A | 11/1987 | Remp et al. | |
| 4,805,653 | A | 2/1989 | Krajicek et al. | |
| 4,823,731 | A | 4/1989 | Howeth | |
| 5,067,558 | A | 11/1991 | Boisture | |
| 5,322,080 | A | 6/1994 | Rankin | |
| 5,423,917 | A | 6/1995 | Garcia, Jr. | |
| 5,474,097 | A | 12/1995 | Lowe et al. | |
| 5,647,906 | A | 7/1997 | Monday et al. | |
| 5,940,920 | A * | 8/1999 | Hare | B08B 9/00 15/104.09 |
| 6,137,028 | A | 10/2000 | Snow | |
| 6,158,074 | A | 12/2000 | Castille | |
| 6,626,195 | B1 | 9/2003 | Garman et al. | |
| 6,676,767 | B2 * | 1/2004 | Chang | B08B 9/0436 134/42 |
| 2007/0119007 | A1 | 5/2007 | Minshall | |
| 2009/0255557 | A1 | 10/2009 | Gardner et al. | |
| 2010/0139019 | A1 | 6/2010 | Geppert et al. | |
| 2013/0220389 | A1 | 8/2013 | Snow | |

* cited by examiner

PIPE CLEANING APPARATUS

CROSS REFERENCE TO RELATED APPLICATION

The current application is a divisional and claims the priority and the benefit of co-pending U.S. patent application Ser. No. 13/385,634 filed on Feb. 27, 2012, entitled "PIPE CLEANING APPARATUS". This reference is hereby incorporated in its entirety.

FIELD

The present embodiments generally relate to blushing, scrubbing, and general cleaning implements and, more particularly, to such implements for cleaning the insides of pipes, tubes, and conduits.

BACKGROUND

The production of oil and gas from subterranean reservoirs frequently results in the build-up of scale within wellbore pipe. Scale of any thickness impedes the flow of oil and gas through the pipe, lowering oil and gas production rates. Furthermore, thick scale accumulations prevent the movement of tools within the pipe. It is, therefore, desirable to prevent scale from forming.

When efforts to this end are unsuccessful, however, the pipe must often be mechanically cleaned. Scale is frequently created when reservoir liquids transport dissolved sulfates through wellbore pipe. As the liquids approach the earth's surface, reductions in temperature and pressure cause the sulfates to precipitate out of solution and collect on the inside of the pipe. Scale deposits can vary in consistency from a thick sludge to a brittle solid, making their removal difficult. Further complicating the removal of scale from oilfield pipe is the fact that the scale is often contaminated with radioactive compounds.

Radioactive scale which has accumulated on oilfield pipe is considered to be a naturally occurring radioactive material (NORM). NORM removed from tubing can vary greatly in terms of its radioactivity. Some NORM samples have been found to possess a level of radioactivity that is roughly 100,000 times higher than typical soil. Although the NORM found in oilfield tubing is generally considered to be non-hazardous, it is desirable to minimize human contact with it.

Cleaning oilfield pipe can expose workers to NORM that may pose health risks. Inadvertent inhalation and ingestion of NORM for prolonged periods can increase the risk of cancer and bone abnormalities. Radioactivity from NORM brought close to a human body can also penetrate skin causing cellular damage. A safe limit for exposure to NORM is unknown and can vary from person to person.

The cleaning of oilfield pipe generally involves the insertion of a tool-carrying lance into the pipe. Once inside the pipe, the tool engages the scale. By the rotation of the tool or the pipe, the scale is typically scraped from the interior wall of the tubing. The dislodged scale particles are flushed from the tubing by a stream of water or air channeled through the lance. Afterward, the scale particles are collected for safe disposal.

Since the cleaning of scale from oilfield pipe often results in the concentration of NORM, it is especially important to prevent its uncontrolled spreading. Unfortunately, the available equipment for cleaning oilfield pipe has been known to create a "toxic dust" that can be blown by the wind into surrounding neighborhoods. Furthermore, this equipment is not especially good at removing scale having great hardness from the interior of pipe.

In light of the problems associated with the known equipment for cleaning pipe, it is a principal object of my invention to provide an apparatus that will thoroughly and quickly remove scale of any density or hardness from the interior of pipes, tubes, and conduits of any diameter or length.

Embodiments of the invention to provide an apparatus of the type described that collects, in stages, all scale removed from the interior of pipes, tubes, and conduits thereby preventing environmental contamination. Users of the apparatus are not brought into direct contact with scale.

Embodiments of the invention provide a cleaning apparatus that permits multi-stage pipe cleaning by featuring a number of tool-bearing lances for sequential entry into pipes, tubes, and conduits. One of the lances carries a mill for removing the bulk of the scale found within a pipe, tube, or conduit. Another of the lances carries an air-driven tube cleaner or "rattle" for removing substantially all of the scale that may have been left by the mill within a pipe, tube, or conduit. Still another of the lances carries a jet nozzle for blasting the interior of a pipe, tube, or conduit with a cleaning liquid after the passage of the air-driven tube cleaner.

Embodiments of the invention provide improved elements and arrangements thereof in a cleaning apparatus for the purposes described which is relatively inexpensive to manufacture and dependable in use.

The foregoing embodiments, features and advantages of the pipe cleaning apparatus will become readily apparent upon further review of the following detailed description of the preferred embodiment as illustrated in the accompanying drawings.

BRIEF DESCRIPTION OF THE DRAWINGS

The detailed description will be better understood in conjunction with the accompanying drawings as follows.

Figure 1:
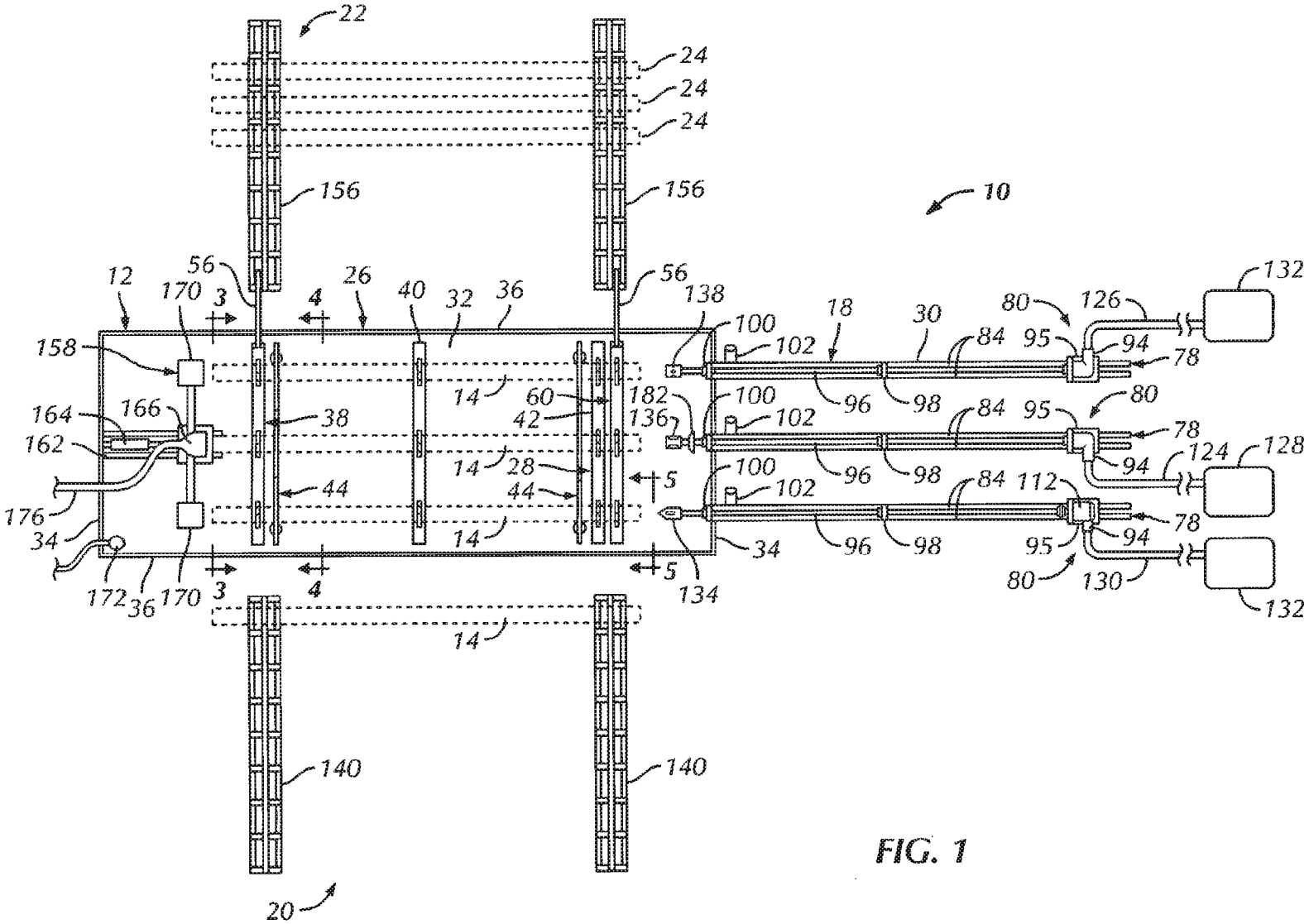
FIG. 1 is a top plan view of the processor portion of my pipe cleaning apparatus.
Figure 2:
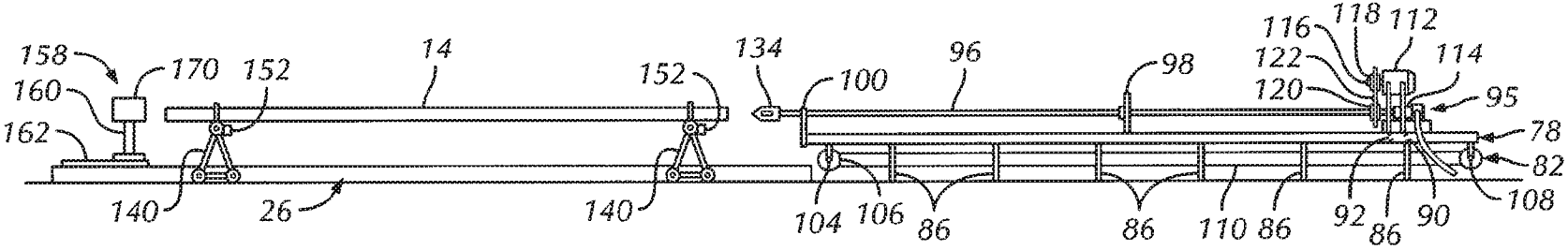
FIG. 2 is a side elevational view of the processor portion of my pipe cleaning apparatus.
Figure 4:
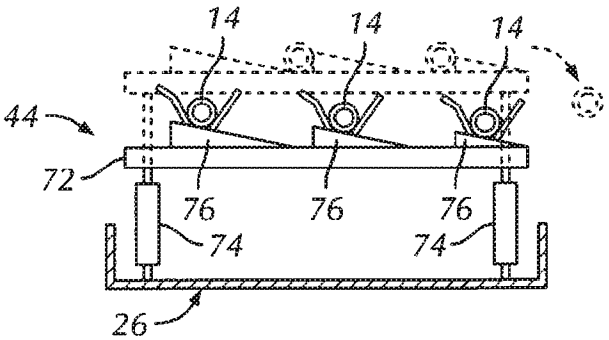
FIG. 4 is a cross-sectional view taken along line 4-4 of FIG. 2
Figure 3:
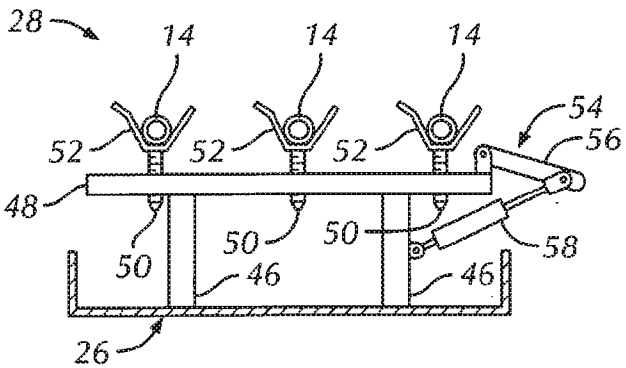
FIG. 3 is a cross-sectional view taken along line 3-3 of FIG. 2.
Figure 6:
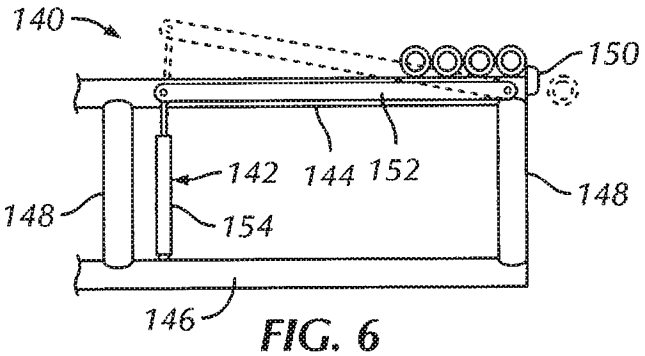
FIG. 6 is a side elevational view of the inner end of the pipe feeder portion of my pipe cleaning apparatus.
Figure 5:
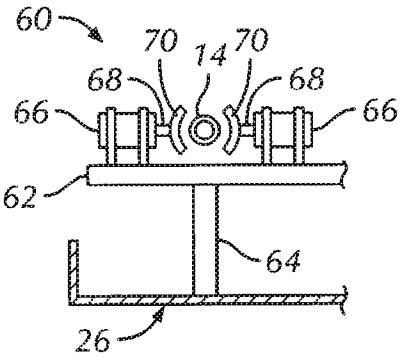
FIG. 5 is a cross-sectional view taken along line 3-3 of FIG. 2
Figure 7:
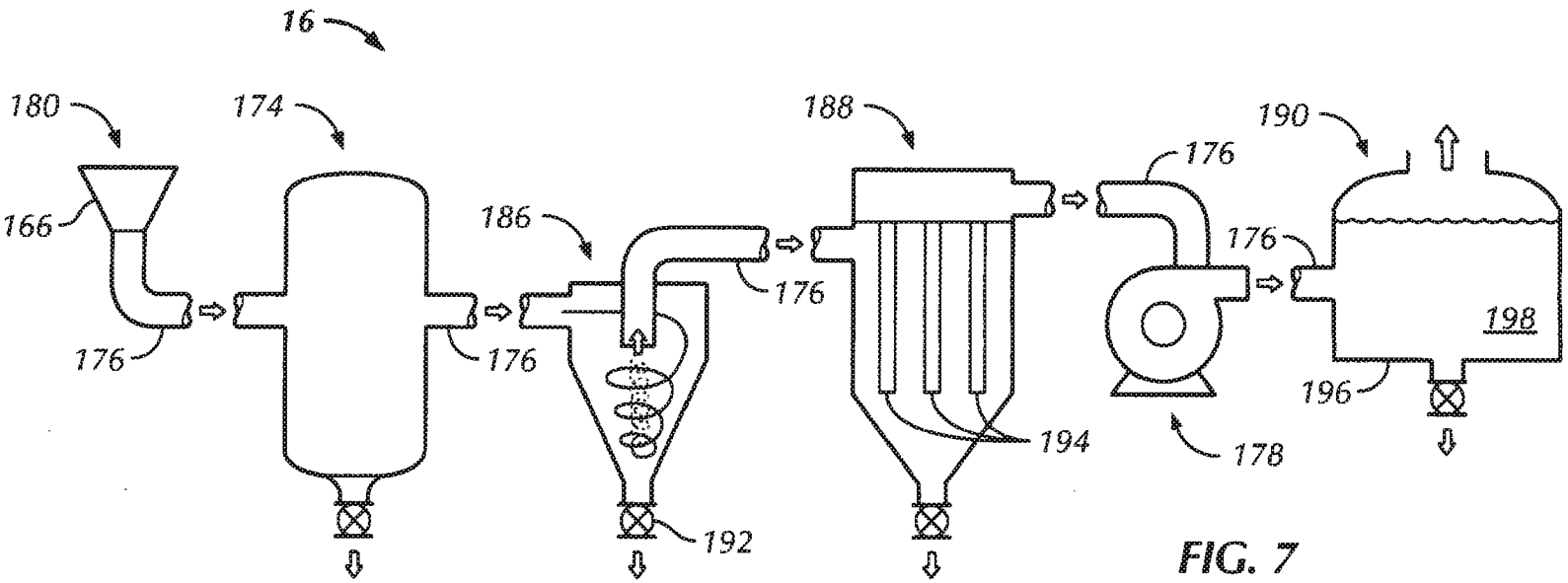
FIG. 7 is a schematic view of the collector portion of my pipe cleaning apparatus.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

Referring now to the Figures, an exemplary embodiment of my pipe cleaning apparatus is illustrated generally at 10. The apparatus 10 includes a processor 12 for removing scale from interior of scale-laden pipe 14 and a collector 16 for gathering the scale liberated by the processor 12. The scale gathered together by the collector 16 is periodically discharged from the collector 16 and 15 disposed of in an environmentally safe manner and, perhaps, in a subterranean excavation.

The processor 12 has a scale remover 18 for sequentially dislodging scale from pipe and directing the liberated scale toward the collector 16. A pipe feeder 20 delivers the scale-laden pipe 14 to the scale remover 18. A pipe receiver 22 accepts scale-free pipe 24 from scale remover 18 and holds the scale-free pipe 24 until it can be carried away for reuse. The scale remover 18 includes an elongated, drain pan 26 for recovering water used in the cleaning of scale-laden pipe 14. A pipe support assembly 28 is positioned within the drain pan 26 to hold scale-laden pipe 14 while such is being cleaned. A tool conveyor 30 selectively extends a number of cleaning implements, described herein below, and into the scale-laden pipe 14 held by the pipe support assembly 28.

The drain pan 26 includes a bottom wall 32 having a length that is somewhat greater than that of the scale-laden pipe 14 and the width that is sufficient to receive three joints of scale-laden pipe 14 positioned side-by-sides in a spaced-•apart relationship. A respective one of a pair of end walls 34 projects upwardly from each of the opposite ends of the bottom wall 32. A respective one of a pair of side walls 36 projects upwardly from each of the opposite sides of the bottom wall 32 and connects the end walls 34 together. If desired, the bottom wall 32 can be provided with a recess (not shown) that serves as a sump for cleaning water that falls into the drain pan 26.

The pipe support assembly 28 includes three bridges 38, 40, and 42 spaced along the length of the drain pan 26. The assembly 28 also has a pair of pipe conveyors 44 for moving pipe 14 across the bridges 38-42. A respective one of the pipe conveyors 44 is positioned adjacent each of the outermost bridges 38 and 42.

Each of the bridges 38-42 includes a pair of uprights 46 that project upwardly from the bottom wall 32 of the drain pan 26. A cross piece 48 is affixed atop the pair of uprights 46 and extends across the width of the bottom wall 32. Three jack screws 50 extend upwardly from the cross piece 48 in a spaced-apart relationship. The jack screws 50 are threadably engaged with the cross piece 48 and can be manually rotated so as to selectively elevate the tops of the jack screws 50 above the cross piece 48.

A respective one of a plurality of V-shaped cradles 52 is affixed to the top of each of the jack screws 50. Each cradle 52 is sized to receive a portion of a pipe 14 therein.

Each of the bridges 38 and 42 is provided with a boom assembly as at 54 for gently rolling pipe 24 onto the pipe receiver 22. Such an assembly 54 includes a boom arm 56 pivotally fastened at its inner end to a cross piece 48 and a. hydraulic ram 58 that connects the middle of the boom arm 56 to the bottom of an upright 46. By selectively energizing the hydraulic ram 58, the outer end of the boom arm 56 is raised and lowered.

A pipe anchor 60 is provided adjacent the bridge 42 nearest the tool conveyor 30. The pipe anchor 60 has a horizontal beam 62 supported by a pair of posts 64 extending upwardly from the bottom wall 32 of drain pan 26. Affixed to the top of the beam 62 are three pairs of hydraulic rams 66.

Each of the pairs of hydraulic rams 66 has a pair of opposed actuator arms 68 each of which carries a C-shaped clamping member 70 at its free end for engagement with one side of a pipe 14. The rams 66 are arranged so that pipes 14 positioned within the cradles 52 are locked in place by the clamping members 70 when the actuator arms 68 are extended toward one another. It is a matter of design choice whether or not each pair of hydraulic rams 66 is operated independently of, or in concert with, the other pairs of hydraulic rams 66.

Each of the pipe conveyors 44 includes a crossbeam 72 positioned adjacent one of the cross pieces 48. The crossbeam 72 is supported at its opposite ends by a pair of hydraulic rams 74 extending upwardly from the drain pan 26. Affixed to the crossbeam 72 are three, identical, triangular ramps 76 which are positioned side-by-side and whose top surfaces slope downwardly toward the pipe receiver 22. By selectively activating the hydraulic rams 74, the crossbeam 72 and the ramps 76 are elevated to first lift the pipes 14 held within the cradles 52 and, then, roll the pipes 14 toward the pipe receiver 22.

When the hydraulic rams 74 are subsequently deactivated, the ramps 76 are lowered thereby depositing the pipes 14 within the cradles 52 next closest to the pipe receiver 22. In the case of the pipe 14 held within the cradles 52 closest to the pipe receiver 22, elevating the crossbeam 72 and the ramps 76 causes the pipe 14 to roll onto the downwardly sloping boom arms 56 for a smooth transmission to the pipe receiver 22.

The tool conveyor 30 includes three, parallel guideways 78 upon each of which a tool assembly 80 moves by means of an associated drive assembly 82. As shown, the guideways 78 are axially aligned with the cradles 52. The guideways 78 are also configured so as to bring the tool assemblies 80 into engagement with pipe 14 held by the cradles 52.

Each of the guideways 78 includes a pair of tracks or rails 84 supported at a fixed height above the ground by a number of spaced apart posts 86. The tracks 84 are C-shaped, channel members that are set a short distance apart, parallel to one another. The channel members open toward each other so as to define a containment space 88 there between. The tool assemblies 80 run within, and above, the containment space 88.

Each of the tool assemblies 80 has tool carrier 95 with a chassis 90 and attached wheels 92 that ride within the tracks 84 of the guideways 78. Each chassis 90 carries a hose fitting 94. An elongated, tubular lance 96 is connected to the hose fitting 94 and extends forwardly therefrom. The lance 96 has a length substantially equal to that of pipe 14. To prevent buckling of the lance 96 as it is advanced axially into a pipe 14 held by cradles 52 as will be described herein below, a wheeled support 98 is provided on the tracks 84 ahead of the chassis 90. A fixed support 100 is provided for the lance 96 at the inner end of each pair of tracks 84.

One drive assembly 82 is associated with each pair of tracks 84. Each drive assembly 82 includes a hydraulic motor 102 affixed to one and the pair of tracks 84. The motor 102 has a rotating driveshaft 104 to which is affixed a drive sprocket 106. The drive sprocket 106 is positioned for rotation between a pair of tracks 84. An idler sprocket 108 is affixed to each pair of tracks 84 at the end opposite that to which the hydraulic motor 102 is affixed.

The drive sprocket 106 and idler sprocket 108 rotate in a vertical plane and snugly support an endless chain 110. A chassis 90 is attached to an endless chain 110 such that when the hydraulic motor 106 is caused to operate in a forward direction, the chassis 90 is advanced toward the pipe support 28 and when the hydraulic motor 102 is caused operate in a rearward direction, the chassis 90 is moved away from the pipe support 28. One of the tool carriers 95 is shown to be modified so that its associated lance 96 can be rotated. To this end, a hydraulic motor 112 is mounted upon the chassis 90 and the hose fitting 94 is provided with a water-tight swivel 114 for connection to the lance 96. The motor 112 has a rotating driveshaft 116 carrying a drive sprocket 118. Also, a driven sprocket 120 is fitted around the lance 96 adjacent the motor 112. An endless chain 122 connects the sprockets 118 and 120 together such that, when the motor 112 is energized, the lance 96 is caused to rotate on the swivel 114.

The tool carriers 95 are connected through their hose fittings 94 to different cleaning fluid sources. The flexible hose 124, for example, are charged with pressurized air from a remote compressor 128. On the other hand, the flexible hoses 126 and 130 is charged with pressurized water from a remote pump 132. The lances 96, being hollow, transport the fluids received through the hose fittings 94 to the free ends thereof The lances 96 carry different tools at their free ends and are used for sequentially removing scale tenaciously gripping the interior surfaces of pipe 14. A. mill 134 is affixed to one of the lances 96, the one closest to the pipe feeder 20. The mill 134 has small teeth (not shown) for less aggressive, yet faster, scale cutting that is less prone to stall the motor 112. The mill 134 also has small openings (not shown) therein for jetting water that cools and lubricates the mill 134 as it penetrates a pipe 14.

Additionally, an air-driven tube cleaner or rattle 136 is affixed to the middle one of the lances 96 for removing the scale that may have been left behind by the mill 134. Finally, a water jet nozzle 138 is affixed to the remaining lance 96. In use, water blasts through radial openings (not shown) in the nozzle 138 forming small bubbles that collapse on impact with the scale causing a forceful, erosive effect that is not damaging to pipe 14.

Water ejected by the mill 134 and the jet nozzle 138 runs out of pipe 14 and collects in the drain pan 26. This water carries scale particles removed from the pipe 14 with it. The scale particles, being denser than water, settle to the bottom of the drain pan 26. The pipe feeder 20 includes a pair of pipe racks 140 each of which is outfitted with a pipe rolling assembly 142 at its inner end. As illustrated, the pipe racks 140 are positioned parallel to one 10 another and are also positioned at tight angles to the scale remover 18. The pipe racks 140 are set sufficiently far apart so as to support the scale-laden pipe 14 near the opposite ends thereof.

Each pipe rack 140 is pyramidal in cross section and has a top rail 144 supported by, and connected to, a pair of ground-engaging, bottom rails 146 by a number of cross-members 148. The top rail 144 of each pipe rack 140 is held by the cross-members 148 at a height that is greater than that of the cradles 52.

An elevated stop 150 projects upwardly from the inner end of each top rail 144 to prevent pipe 14 from rolling off of pipe racks 140. Each stop 150 has a height substantially equal to the outer diameter of the scale-laden pipe 14.

A pipe-rolling assembly 142 is positioned between the top rail 144 and bottom rails 146 of each pipe rack 140. Each pipe-rolling assembly 142 includes a rolling arm 152 that is pivotally connected to the top rail 144 adjacent the stop 150. The rolling arm 152 normally extends parallel to the top rail 144 outwardly and away from the scale remover 18. A hydraulic ram 154 supports the outer end of the rolling arm 152 and connects the outer end of the rolling arm 152 to the bottom rails 146 of a pipe rack 140. By selectively actuating the hydraulic ram 154, the outer end of the rolling 152 can be elevated and the inner end of the rolling aim 152 can be simultaneously lowered. This action permits a scale-laden pipe 14 to pass over the stop 150 and come to rest in the cradles 52 of the scale remover 18.

The pipe receiver 22 is a pair of pipe racks 156 which are constructed in a manner which is substantially similar to pipe racks 140. The pipe racks 156 are positioned parallel to one another and are also positioned at right angles to the scale remover 18. The pipe racks 156 are set sufficiently far apart so as to support the scale-free pipe 24 near the opposite ends thereof in a stable manner. The pipe racks 156 are somewhat lower than the upper ends of the boom arms 56 so that gravity can assist in moving the scale-free pipe 24 onto the pipe racks 156 yet have a height sufficient to support the scale free pipe 24 horizontally above the ground.

The cleaning of pipe 14 inherently produces large quantities of particulates that would be discharged into the environment if it were not contained and gathered. The collector 16 takes care of 15 this by pumping particulate-laden water from the drain pan 26. The collector 16 also pumps particulate-laden air from the pipe 14 being cleaned by the air-driven tube cleaner 136.

The collector 16 includes a hood assembly 158 positioned at the end of the drain pan 26 opposite the tool conveyor 30. The hood assembly 158 has a frame 160 slidably mounted upon tracks 162 that are structurally similar to those provided to the guideways 78. A hydraulic ram 164 connects the frame 160 to the end wall 34 of the drain pan 26 and, when actuated, selectively moves the frame 160 toward the bridges 38-42 and the pipe 14 supported thereon. A bell-shaped, dust hood 166 is affixed to the frame 160 for drawing dust-like particles from the pipe 14 cleaned by the air-driven tube cleaner 136 into a multi-stage dust collector 168. Affixed to the frame 160 on opposite sides of the dust hood 166 is a pair of box-like spray deflectors 170 that directs particulate-laden water emanating from pipe 14 cleaned by the mill 134 and the jet nozzle 138 downwardly into the drain pan 26.

Particulate-laden water is removed from the drain pan 26 by a sump pump 1'72 and delivered to a remote settling chamber 184. The sump pump 172 sits on the bottom wall 32 of the drain pan 26 in a convenient location. The sump pump 172 can be run continuously as pipe 14 is being cleaned or the pump 172 can be outfitted with a float switch (not shown) that energizes the pump 172 when the water level within the drain pan 26 reaches a pre-set height.

The dust hood 166 is connected by a conduit 176 to a fan 178. The fan 178 creates a partial vacuum within the dust hood 166 and draws particulate-laden air at a high rate from a joint of pipe 14 inserted into the central opening 180 of the dust hood 166. The central opening 180 is sized to closely fit around one end of a joint of pipe 14 so as to prevent the escape of dust-like particles. To further prevent the escape of dust-like particles, a large-diameter gasket 182 is slidably fitted upon the lands 96 adjacent to the air-driven tube cleaner 136. When the air-driven tube cleaner 136 is inserted into a pipe 14, the gasket 182 moves into abutment with the pipe 14 substantially sealing its end remote from the dust hood 166. Withdrawing the air-driven tube cleaner 136 from a pipe 14 breaks the seal and moves the gasket 182 back to its starting position.

A number of dust collectors are connected in series on conduit 176 to trap particulates and prevent their release into the atmosphere. Particularly, a settling chamber 184, cyclonic separator 186, and a baghouse 188 are serially connected to the conduit 176 upstream of the fan 178. A wet scrubber 190 is connected to the conduit 176 downstream of the fan 178. The settling chamber 184 receives air directly from the dust hood 166. The settling chamber 184 consists of a large, air- and water-tight box. The sudden reduction of speed of the air as it passes through the settling chamber 184 causes heavier dust particles to settle out of the dust-laden air and fall to the bottom of the chamber 184 where such is periodically removed. Because of its large space requirement and low efficiency, the settling chamber 184 serves as a pre-cleaner for the more efficient dust collectors downstream.

The cyclonic separator 186 receives the flow of air from the settling chamber 184. The cyclonic separator 186 uses cyclonic action to separate particulates from air. It does this by creating a pair of nested vortices that separate coarse particulates from fine ones. The principal vortex spirals downwardly and outwardly and carries most of the coarse particulates in it. Centrifugal force created by the circular flow of the principal vortex throws the coarse particulates toward the outer wall of the separator. After striking the outer wall, the coarse particulates fall to the bottom of the separator 186 under the influence of gravity where they are removed through a valve 192. The inner vortex, created near the bottom of the separator 186, spirals upwardly carrying finer particulates that are discharged to the baghouse 188.

The baghouse 188 employs fabric bags 194 to separate particulates from the air. Dust-laden air enters the baghouse 188 and passes through fabric bags 194 that act as filters. The bags 194 can be formed of cotton, synthetic materials, or even fiberglass and can be formed into tubes or envelopes.

Baghouses 188 are known to be one of the most efficient and cost-effective types of dust collectors available. Depending on the type of bags 194, the baghouse 188 can collect more than 99 percent of the fine particulates supplied to it.

Air from the baghouse 188 travels to the fan 178. The substantially dust-free air passes through the fan 178, cooling it.

The wet scrubber 190 receives the output from the fan 178. The wet scrubber 190 is an open topped vessel 196 that is partially filled with a scrubbing liquid 198, namely water. The air inlet for the wet scrubber 190 is located at the bottom of the open topped vessel 196 so that the airstream which may contain very fine particulates is forced into contact with the scrubbing liquid 198 before it is exhausted through the top of the open topped vessel 196. By increasing the depth of the scrubbing liquid 198, the contact time between the air and the scrubbing liquid 198 will be increased thereby yielding a higher particulate removal efficiency. Periodically, the scrubbing liquid 198 and any suspended particulates are drained from the open topped vessel 196 and disposed of in a safe manner.

The use of my apparatus 10 is straightforward. First, a load of scale-laden pipe 14 is positioned on the pipe racks 140. Then, a pipe 14 is passed over the stops 150, by actuating the hydraulic rams 154 to pivot the rolling arms 152 upwardly, and is then rolled under the influence of gravity into the nearest, first pair of cradles 52. Next, the hydraulic rams 66 are actuated so as to lock the first pipe 14 in place with the clamping members 70. Afterward, the lance 96 carrying the mill 134 is caused to rotate by actuating the hydraulic motor 112 and the pump 132 is energized to deliver a stream of water to the mill 134. Now, the hood assembly 158 is advanced toward the first pipe 14 by energizing the hydraulic ram 164 so that a spray deflector 170 is positioned to direct water flow from the first pipe 14 downwardly into the drain pan 26.

Afterward, the hydraulic motor 102 is energized to advance the rotating mill 134 into and through the first pipe 14. As the mill 134 moves through the first pipe 14, scale is dislodged and flushed from the first pipe 14. Milling is completed when the directions of operations of the hydraulic rams 66 and 164 and the hydraulic motor 102 are reversed by an operator so as to withdraw the clamping member 70, the hood assembly 158, and the mill 134 from the first pipe 14. The pump 132 is de-energized before the mill 134 is withdrawn from the first pipe 14 to avoid splashing.

Once milled, the first pipe 14 is moved to the middle pair of cradles 52 by means of the pipe conveyors 44. Actuating the hydraulic rams 74 elevates the ramps 76 thereby causing the first pipe 14 to rise and roll a short distance sideways. Returning the hydraulic rams 74 to their original, lowered position drops the first pipe 14 into the second, middle pair of cradles 52 for more cleaning.

A second pipe 14 is introduced to the scale remover 18 after the first pipe 14 is shifted to a non-interfering position in the middle of the scale remover 18. To this end, the second pipe 14 is moved into the first pair of cradles 52 in the same manner as the first pipe 14. Now, with the second pipe 14 positioned within the first pair of cradles 52 and the first pipe 14 positioned within the second pair of cradles 52, the hydraulic rams 66 are actuated so to lock the first and second pipes 14 in place with the clamping members 70. Next, the lance 96 carrying the mill 134 is rotated by actuating the hydraulic motor 112. Further, the pump 132 is energized to deliver a stream of water to the mill 134 and the air compressor 128 is energized to deliver air at high pressure to the air-driven tube cleaner 136. The fan 178 is also energized to draw air into the hood assembly 158. The hood assembly 158 is now advanced toward the first and second pipes 14 by energizing the hydraulic ram 164 so that the dust hood 166 receives one end of the first pipe 14 therein and a spray deflector 170 is positioned closely adjacent one end of the second pipe 14 to direct water flow downwardly.

Afterward, the hydraulic motors 102 are energized to advance the rotating mill 134 into and through the second pipe 14 and the tube cleaner 136 into and through the first pipe 14. As the mill 134 moves through the second pipe 14, scale is dislodged and flushed from the second pipe 14 into the drain pan 26. At the same time, the tube cleaner 136 removes virtually all of the scale that may remain within the first pipe 14. The milling and "rattling" steps of the cleaning process are completed when the directions of operations of the hydraulic rams 66 and 164 and the hydraulic motor 102 are reversed so as to withdraw the clamping members '70, the hood assembly 158, the mill 134, and the tube cleaner 136 away from the first and second pipes 14. The compressor 128 and pump 132 are preferably deenergized just before the mill 134 and the tube cleaner 136 are withdrawn from the first and second pipes 14.

The first and second pipes 14 are simultaneously moved toward the pipe racks 156. Movement usually occurs after the first pipe 14 has been rattled by the tube cleaner 136 and the second pipe 14 has been milled. Movement is affected by actuating the hydraulic rains 74 which elevates the ramps 76 and causes the first and second pipes 14 to roll short distances laterally. Returning the hydraulic rams 74 to their original, lowered positions drops the first pipe 14 into the third pair of cradles 52 and drops the second pipe into the second pair of cradles 52. A third pipe 14 is introduced to the scale remover 18 after the first and second pipes 14 are shifted over. This is accomplished by moving the third pipe 14 into the first pair of cradles 52 by the action of the rolling arms 152. Now, with the third pipe 14 positioned within the first pair of cradles 52 and with the second pipe 14 positioned within the second pair of cradles 52 and the first pipe 14 positioned within the third pair of cradles 52, the hydraulic rams 66 are actuated so as to lock the first, second, and third pipes 14 in place with the clamping members 70. Next, the lance 96 carrying the mill 134 rotated by actuating the hydraulic motor 112.

Further, the pump 132 is energized to deliver a stream of water to the mill 134 and the jet nozzle 138. Also, the air compressor 128 is energized to deliver air to the tube cleaner 138, and the fan 178 is also energized to draw air through the hood assembly 158. The hood assembly 158 is, now, moved toward the first, second, and third pipes 14 by energizing the hydraulic ram 164 so that the dust hood 166 receives one end of the second pipe 14 therein and the spray deflectors 170 are positioned closely adjacent one end of the first and third pipes 14. Afterward, the hydraulic motors 102 are energized to advance the rotating mill 134 into and through the third pipe 14 and advance the tube cleaner 136 through the second pipe 14 and, further, advance the jet nozzle 138 through the first pipe 14. As the mill 134 moves through the third pipe 14, scale is dislodged and flushed from the third pipe 14 into the drain pan 26. At the same time, the tube cleaner 136 removes the remaining scale in the second pipe 14 to the dust hood 166. Also, the jet nozzle 138 blasts the interior of the first pipe 14 and flushes any scale residue into the drain pan 26.

The milling, rattling, and blasting steps of the cleaning process are completed when the directions of operations of the hydraulic rams 66 and 164 and the hydraulic motor 102 are reversed so as to withdraw the clamping members 70, the hood assembly 158, the mill 134, the tube cleaner 136, and the jet nozzle 138 away from the first, second, and third pipes 14. The compressor 128 and pump 132 are preferably de-energized just before the mill 134, the tube cleaner 136, and the jet nozzle 138 are withdrawn from the first, second, and third pipes 14.

Actuating the pipe conveyors 44, with one pipe 14 being positioned within each of the pairs of cradles 52, results in the first pipe 14 being discharged from the scale remover 18. In this regard, the energization of hydraulic rams 74 lifts the ramps 76 and the first, second, and third pipes 14, The sloping top surfaces of the ramps 76 cause the first, second, and third pipes 14 to roll toward the pipe receiver 22. Under the influence of gravity, the first pipe 14 rolls onto the boom arms 56 (set at an appropriate slope by the suitable actuation of hydraulic rams 58) and, then, onto the pipe receiver 22.

The remaining pipe 14 on the feeder 20 is run through the scale remover 18 in the same manner as the first three pipes 14 outlined above. It is the operator's choice whether to extend all of the lances 96 into the pipe 14 simultaneously or sequentially.

Simultaneous operation certainly saves time, especially if the number of pipes 14 being cleaned is large. Regardless of the manner of operation, the apparatus 10 releases little, if any, scale particles removed from the pipe 14 into the environment. Scale particulates derived from pipe 14 held in the second pair of cradles 52 are sucked up by the collector 16 through the dust hood 166, the gasket 182 preventing upstream particulate escapes. The passage of particulate-laden air through the settling chamber 184, cyclonic separator 186, baghouse 188 and wet scrubber 190 removes virtually all scale particles from the air. The air returned to the atmosphere contains particulates at a level that is too low to measure.

Throughout the cleaning process, the sump pump 172 is energized. Water having suspended scale particulates is continuously pumped to the settling chamber 174 for collection. Scale particulates settling from suspension within the drain pan 26 are conveniently collected after the entire pipe 14 has passed through the scale remover 18.

Once cleaning operations are complete, the apparatus 10 is wholly deenergized and emptied of scale particulates. First, scale particulates are scooped up from the bottom of the drain pan 26. Next, cleaning liquids and scale residue in the settling chamber 174 are collected and removed. Similarly, the scrubbing liquid 198 and scale residue are collected and removed from the wet scrubber 190. Finally, the dry particulates gathered in the cyclonic separator 186 and the baghouse 188 are removed in the normal manner.

The cleaning of the apparatus 10 can be supplemented with a soap and water rinse, if desired. The soap and water contacting the apparatus 10 must, of course, be carefully handled and not permitted to run out upon the ground. It must be disposed of in a safe manner. Once the apparatus 10 has been cleaned out, it is ready for immediate reuse.

While the pipe cleaning apparatus 10 has been described with a high degree of particularity, it will be appreciated by those with experience in the field that modifications can be made to it. For example, all of the elements of the apparatus 10 can be mounted on skids for easy transport to remote locations. Furthermore, elements of the dust collector 16, like the settling chamber 184 and the cyclonic separator 186 can be doubled or tripled in their number to increase particulate collecting efficiencies as well as the times required between cleanouts. Finally, the controls for hydraulic rains such as those shown at 58, 66, 74, 154 and 164 are well known, form no part of the claimed invention, and can be any suitable in the art.

While these embodiments have been described with emphasis on the embodiments, it should be understood that within the scope of the appended claims, the embodiments might be practiced other than as specifically described herein.

What is claimed is:

1. A pipe cleaning apparatus comprising:

a. a pair of cradles for supporting an oilfield pipe;

b. a lance being positioned in axial alignment with the pair of cradles and being adapted to penetrate the oilfield pipe in the pair of cradles;

c. a movable dust hood being adapted to receive the end of the oilfield pipe not penetrated by the lance;

d. a fan being connected to the dust hood for placing a partial vacuum on the dust hood in the oilfield pipe received therein; and e. a gasket being slidably positioned upon the lance and being adapted to move against the oilfield pipe in the pair of cradles and seal the oilfield pipe when the fan is energized.

2. The pipe cleaning apparatus according to claim 1, further comprising a pair of C-shaped clamping members being positioned adjacent a cradle of the pair of cradles for engaging opposite sides of the oilfield pipe and locking the oilfield pipe between the pair of cradles.

3. The pipe cleaning apparatus according to claim 2, further comprising a pair of hydraulic rams for selectively driving the C-shaped clamping members toward one another so as to grasp the oilfield pipe.

* * * * *